US009476553B2

(12) United States Patent
Wang

(10) Patent No.: US 9,476,553 B2
(45) Date of Patent: Oct. 25, 2016

(54) FLASHING NIGHT LIGHT

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 248 days.

(21) Appl. No.: 14/462,573

(22) Filed: Aug. 19, 2014

(65) Prior Publication Data

US 2016/0053951 A1 Feb. 25, 2016

(51) Int. Cl.

| | |
|---|---|
| ***F21S 8/00*** | (2006.01) |
| ***F21S 10/00*** | (2006.01) |
| ***B44C 5/00*** | (2006.01) |
| *F21W 121/00* | (2006.01) |
| *F21V 23/04* | (2006.01) |
| *F21Y 101/02* | (2006.01) |

(52) U.S. Cl.

CPC ..... *F21S 8/035* (2013.01); *B44C 5/00* (2013.01); *F21S 10/002* (2013.01); *F21V 23/04* (2013.01); *F21W 2121/006* (2013.01); *F21Y 2101/02* (2013.01)

(58) Field of Classification Search

CPC ..... F21S 8/035; F21S 10/002

See application file for complete search history.

(56) References Cited

U.S. PATENT DOCUMENTS

| | | | | |
|---|---|---|---|---|
| 2003/0189820 | A1* | 10/2003 | Tell | G02B 6/0021 362/602 |
| 2004/0100800 | A1* | 5/2004 | Wang | F21S 8/035 362/353 |
| 2006/0164823 | A1* | 7/2006 | Jao | B44C 5/005 362/101 |
| 2008/0137378 | A1* | 6/2008 | Lai | F21S 8/035 362/641 |

* cited by examiner

*Primary Examiner* — Elmito Breval

(74) *Attorney, Agent, or Firm* — Leong C. Lei

(57) ABSTRACT

A flashing night light includes: a night light base, a casing mounted to the night light base, a control circuit mounted to the casing and including a control substrate and light-emitting elements, and a light-transmitting unit including first and second light-transmitting plates. The light-emitting elements are controlled by the control substrate to lighten in sequence. Each of the first and second light-transmitting plates has a surface on which a predetermined pattern is formed. The patterns are arranged according to a sequence for desired displaying. The first and second light-transmitting plates include light receiving sections that are arranged to alternate in position and respectively correspond to the light-emitting elements and are fixed to the control substrate. With the light-emitting elements being arranged to lighten in sequence, lights emitting from the light-emitting elements may provide the patterns with an effect of image displaying and achieve a dynamic visual effect.

6 Claims, 9 Drawing Sheets

FLASHING NIGHT LIGHT

TECHNICAL FIELD OF THE INVENTION

The present invention generally relates to a night light, and more particularly to a structure design serving as a visual effect decoration article for use in an environmental space.

DESCRIPTION OF THE PRIOR ART

A night light is provided for the purpose of lighting of a dark corner of an indoor space in the nighttime in order to prevent a person when walking from hitting or kicking any obstacle that may result in risk. In addition, the night light also helps in establishing atmosphere. Thus, manufacturers have developed lampshades of various shapes to attract the attention of the general consumers and to improve the desire of purchasing of the consumers to thereby enhance the market competition power of the products.

However, although the night light can help establishing a desired atmosphere, it provides only a static and still effect. Thus, the design of the night light is an important issue for the manufacturers of the environment lighting. In view of this, the present invention aims to provide a night light that overcomes the above problems.

SUMMARY OF THE INVENTION

An object of the present invention is to improve the visual effect of a night light in order to improve the market competition power.

Thus, the present invention provides a flashing night light, which generally comprises:

a night light base, which has a side on which electric main connection terminals are mounted for connection with a power supply to receive electricity therefrom;

a casing, which is of a three-dimensional configuration and has one side fixed to the night light base;

a control circuit, which comprises a control substrate and a plurality of light-emitting elements, the control substrate being mounted to the casing, the light-emitting elements being mounted to the control substrate in an spaced and alternating manner and controlled by the control substrate to sequentially lighten; and a light-transmitting unit, which comprises a first light-transmitting plate and a second light-transmitting plate that are light transmittable and are arranged to overlap each other, the first light-transmitting plate and the second light-transmitting plate each having a surface on which a predetermined pattern is formed, the patterns being arranged according to a sequence for desired displaying, each of the first light-transmitting plate and the second light-transmitting plate comprising a light receiving section, the light receiving sections being arranged to alternate in position and respectively corresponding to the light-emitting elements and being fixed to the control substrate.

As such, when the power supply is conducted on, the light-emitting elements that correspond to the first and second light-transmitting plates emit lights in a sequence set by the control substrate so as to sequentially display the predetermined patterns to achieve a dynamic visual effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
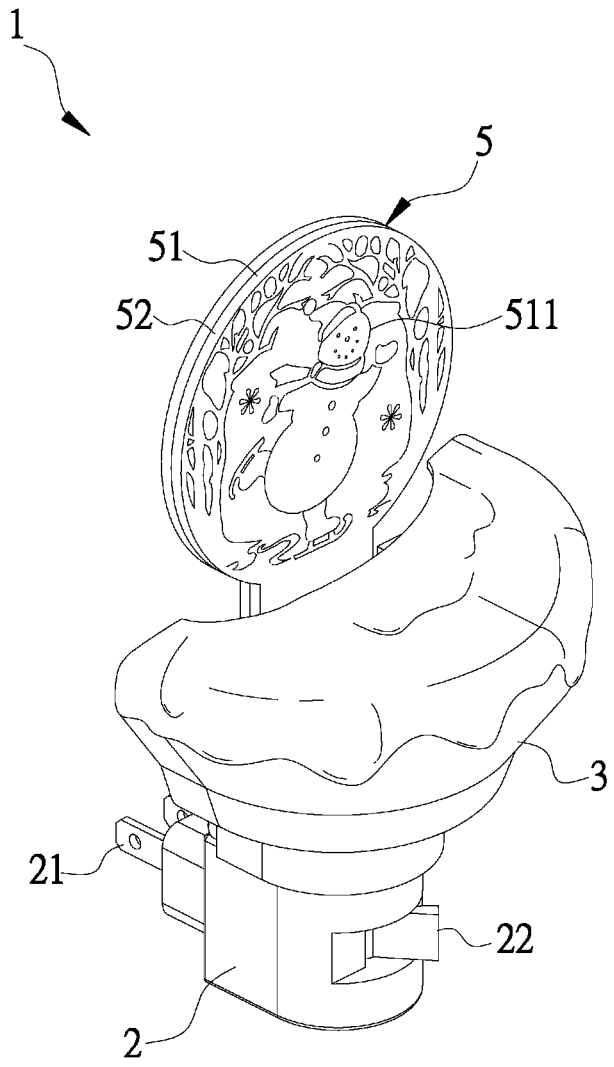
FIG. 1 is a perspective view showing the present invention in an assembled form.
Figure 2:
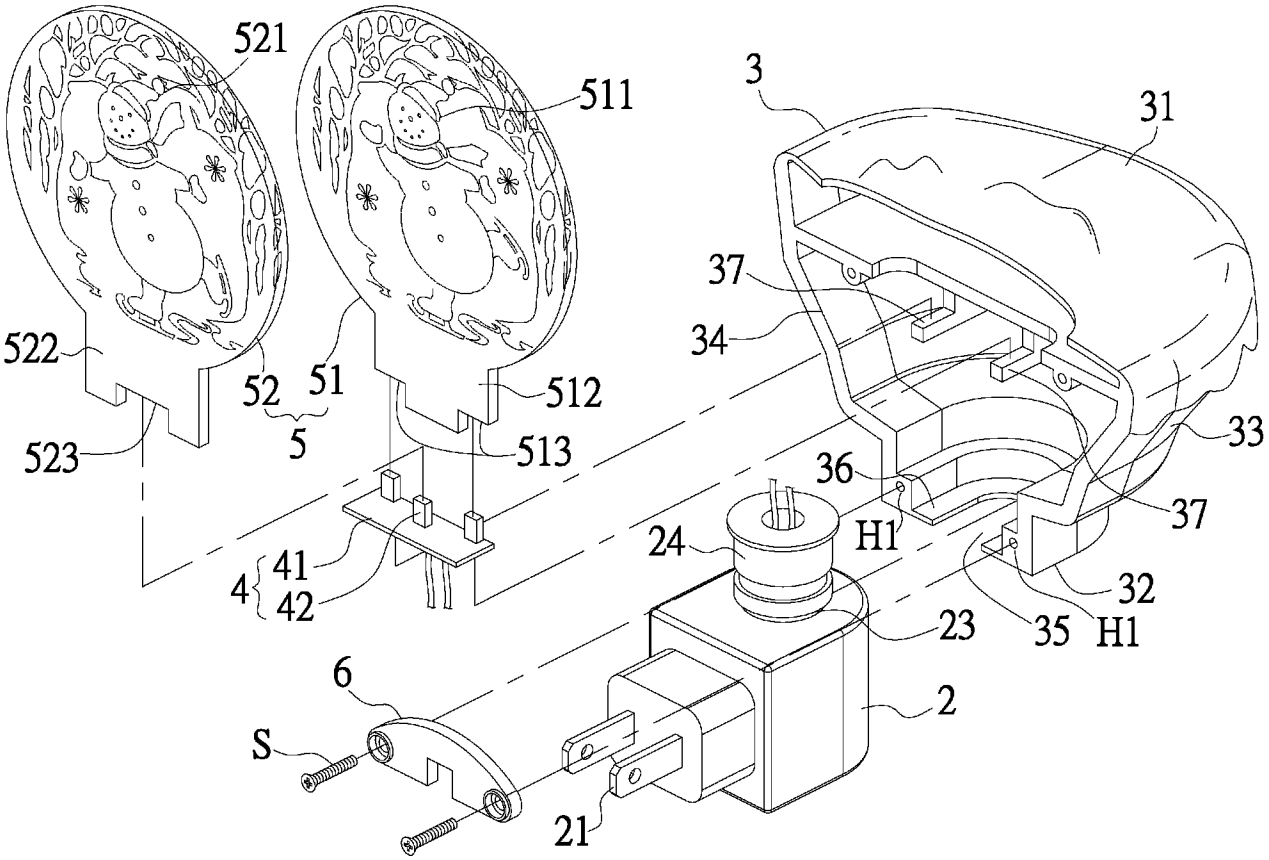
FIG. 2 is an exploded view of the present invention.
Figure 3:
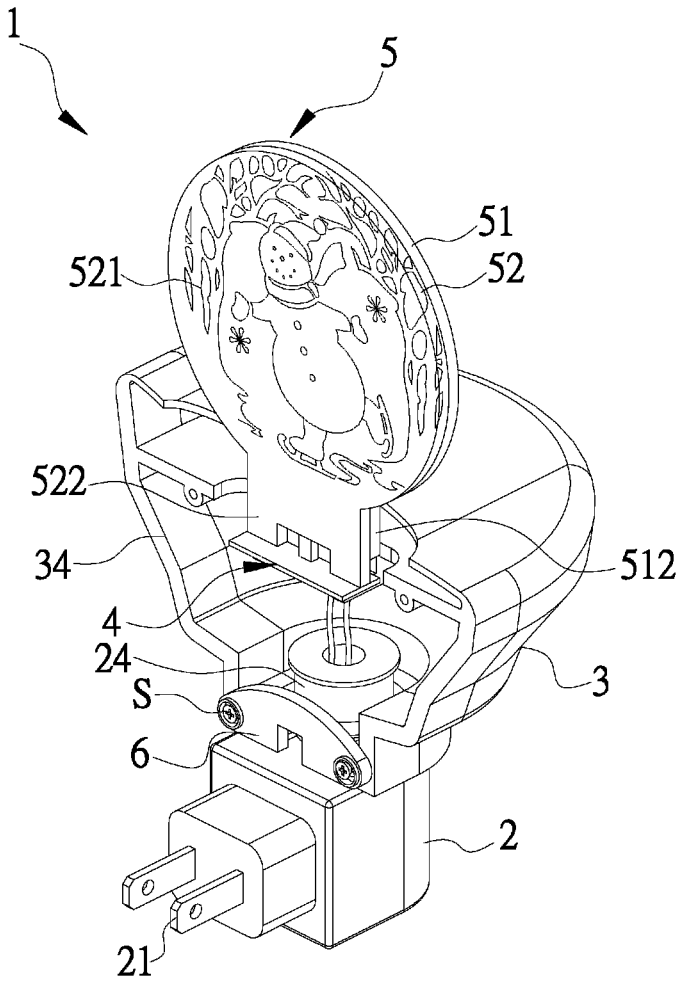
FIG. 3 is a perspective view of the present invention taken from the back side.

Referring to FIGS. 1-3, a flashing night light (1) according to the present invention generally comprises: a night light base (2), a casing (3), a control circuit (4), and a light-transmitting unit (5). The casing (3) is securely fixed to the night light base (2). The control circuit (4) is fixed in the casing (3). The light-transmitting unit (5) is arranged above the control circuit (4).

The night light base (2) has a side on which electric main connection terminals (21) are mounted for connection with a power supply to receive electricity therefrom and an opposite side on which a power switch (22) that controls conduction and/or cut-off of the power supply is mounted and also has a top from which a post (24) extends upward. The post (24) has a lower end portion in which a fitting groove (23) is circumferentially formed.

The casing (3) is of a three-dimensional configuration that is gradually reduced from an upper end to a lower end thereof and comprises an upper end (31), a lower end (32), and a side wall (33) connected between the upper and (31) and the lower end (32). The side wall (33) has a side that is open to form an opening side (34). The lower end of the casing (3) comprises a notch (35) formed therein and the notch (35) has a shoulder (36) extending along a circumference thereof for fitting into the fitting groove (23). The shoulder (36) has opposite sides each comprising a hole (H1) formed therein. Two platforms (37) are formed above and spaced from the shoulder (36). Each of the platforms (37) is formed by extending from the side wall (33) in a direction toward the opening side (34). The casing (3) is fit to the night light base (2) with the opening side (34) thereof. A constraint plate (6) is positioned against the opening side (34) and is secured with threading fasteners (S) screwed into the holes (H1) so as to constrain the night light base (2) from moving with respect to the casing (3).

The control circuit (4) comprises a control substrate (41) and a plurality of light-emitting elements (42). The control substrate (41) is mounted to the platforms (37) of the casing (3) and is fixed to the platforms 937) by adhesive bonding, screwing, or fitting. The light-emitting elements (42) are light-emitting diodes (LEDs) and are mounted to the control substrate (41) in an spaced and alternating manner and are controlled by the control substrate (41) in respect of lighting sequence, lighting timing, and light colors.

The light-transmitting unit (5) comprises a first light-transmitting plate (51) and a second light-transmitting plate (52) that are light transmittable and are arranged to overlap each other. The first light-transmitting plate (51) and the second light-transmitting plate (52) are transparent and each has a surface on which a predetermined pattern (511), (521) is formed. The patterns can be formed through engraving or spraying of bright paints. The patterns can be arranged according to a sequence for desired displaying. Each of the first light-transmitting plate (51) and the second light-transmitting plate (52) has an end from which a light receiving section (512), (522) extends. The light receiving sections (512), (522) are arranged to alternate in position and each comprises a light receiving surface (513), (523). The light receiving surfaces (513), (523) respectively correspond to the light-emitting elements (42). It is noted here that the light receiving surfaces (513), (523) are positioned against tops of the light-emitting elements (42) and the first light-transmitting plate (51) and the second light-transmitting plate (52) are securely mounted to the control substrate (41) with the light receiving sections (512), (522) thereof. In the instant embodiment, a snowman is taken as an example for the patterns (511), (521), but other patterns, such as figures, animals, characters, and totems, can also be used. After assembly, the patterns (511), (521) are located in a direction facing away from the connection terminals (21).

Figure 4:
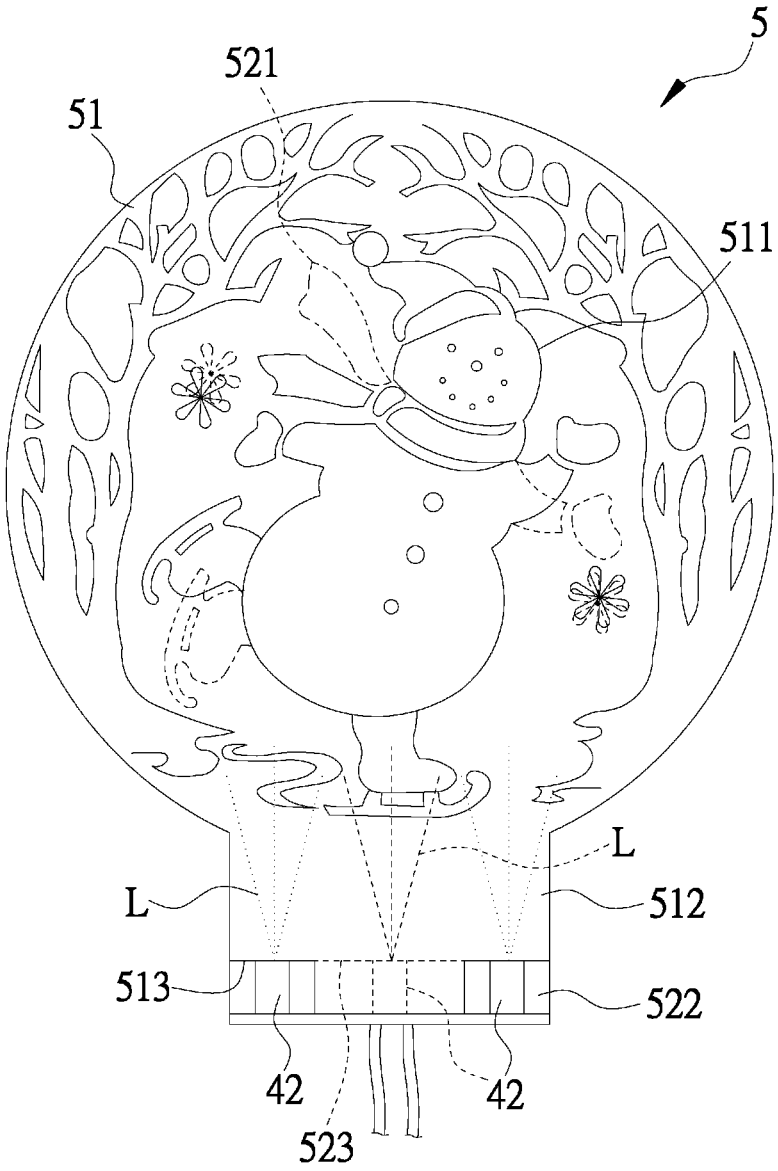
FIG. 4 is a schematic view showing an operation of a light-transmitting unit of the present invention.

Further referring to FIG. 4, phantom lines of the pattern (521) indicate the portions of the pattern (521) of the second light-transmitting plate (52) that is not shielded by the first light-transmitting plate (51). The phantom lines of the lower portion indicate lights (L) that generated by the light-emitting element (42) corresponding to the light receiving surface (523) of the second light-transmitting plate (52). When the connection terminals (21) are plugged into a power socket (not shown) to achieve conduction of the power supply, each of the light-emitting elements (42) emits light (L) sequentially and the lights (L) so generated transmit through the light receiving surfaces (513), (523) into the first light-transmitting plate (51) and the second light-transmitting plate (52) to sequentially display the patterns (511), (521). With the patterns (511), (521) being displayed in sequence, a dynamic visual effect can be achieved thereby improving the market competition power of the present invention.

Figure 5:
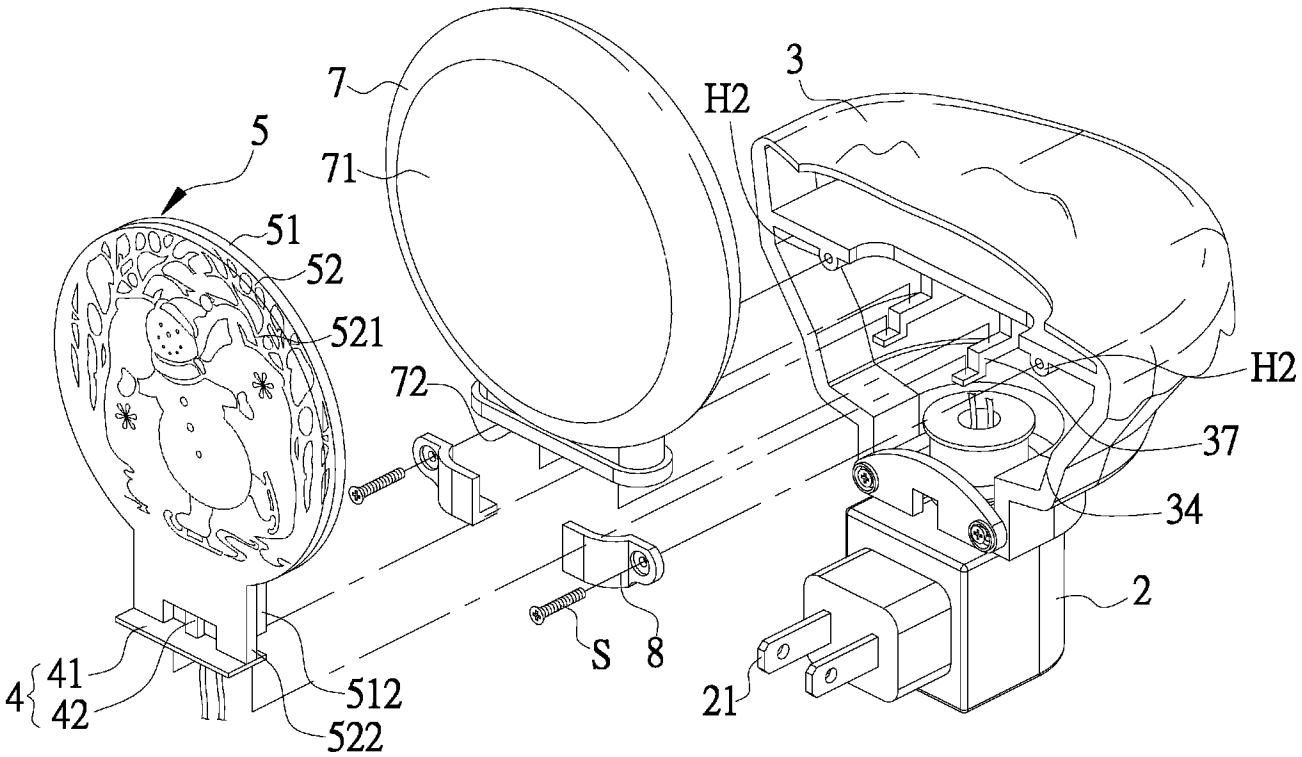
FIG. 5 is an exploded view showing an exemplary embodiment of the present invention.
Figure 6:
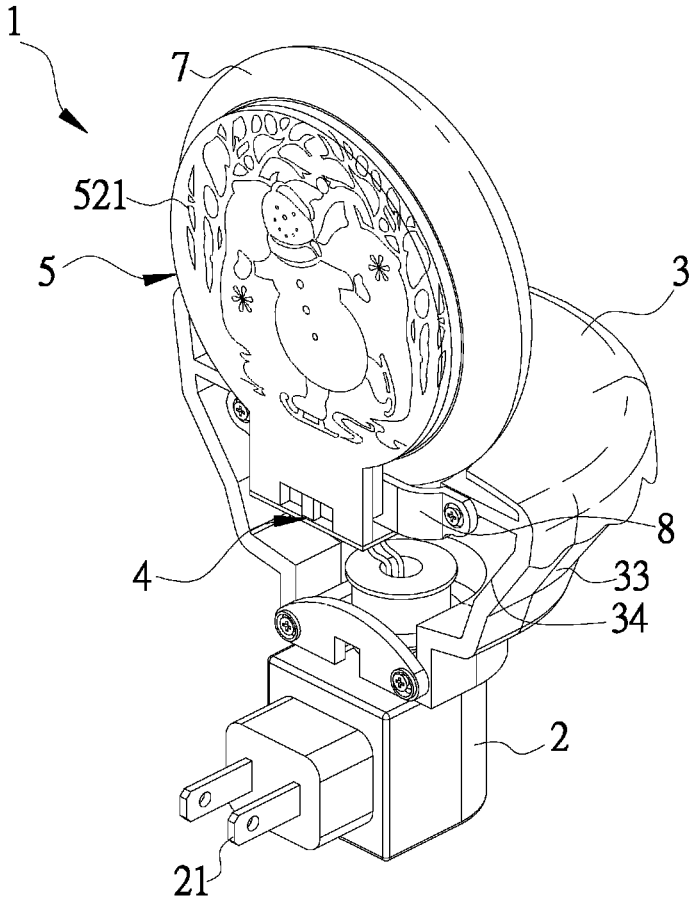
FIG. 6 is a perspective view showing the exemplary embodiment of FIG. 5 in an assembled form.
Figure 7:
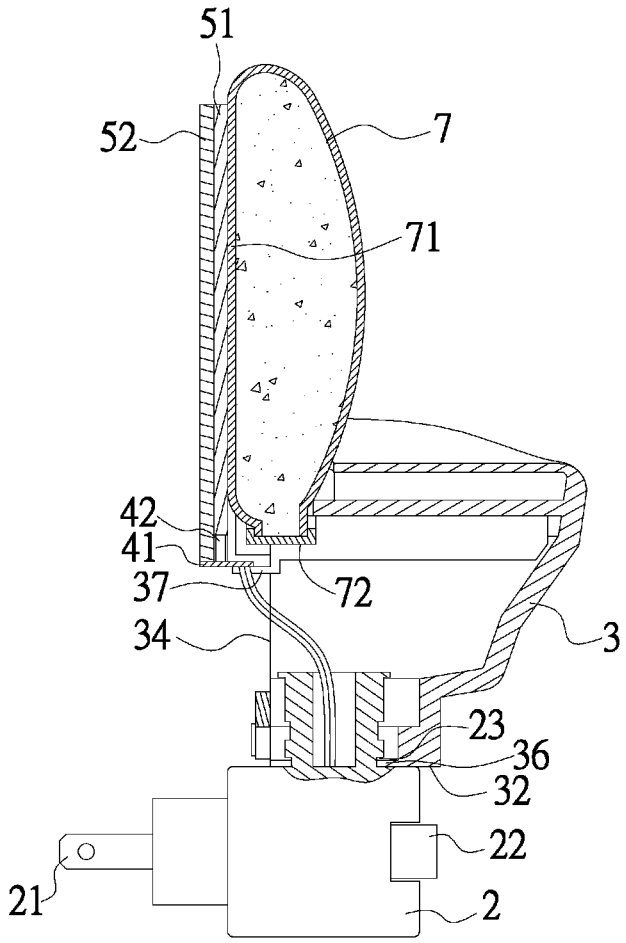
FIG. 7 is a cross-sectional view of FIG. 6.

FIG. 5 is an exploded view showing another embodiment of the present invention and FIG. 6 is a perspective view showing the embodiment in an assembled form. FIG. 7 is a cross-sectional view of FIG. 6. Referring to FIGS. 5-7, the instant embodiment further comprises an aqua-sphere body (7). The aqua-sphere body (7) has a bottom (72) that is securely fixed to the platforms (37) with the planar section (71) facing a direction toward the connection terminals (21) and bonded to a surface of the first light-transmitting plate (51) of the light-transmitting unit (5).

Further, the embodiment further comprises two opposite fixing blocks (8), which are positioned against opposite sides of the aqua-sphere body (7) and are each secured by a threading fastener (S) to the opening side (34) of the night light base (2). Opposite sides of the opening side (34) are provided with holes (H2) to receive the threading fasteners (S) to screw therein so as to constrain the aqua-sphere body (7) from moving with respect to the casing (3).

It is noted here that when the light-transmitting unit (5) is in a condition of image displaying, the patterns (511), (521) are subjected to an effect of magnification when viewed through the aqua-sphere body (7). Further, the liquid contained in the aqua-sphere body (7) may flow and cause refraction of the lights (L), resulting in a brilliant and gorgeous visual effect.

Figure 8:
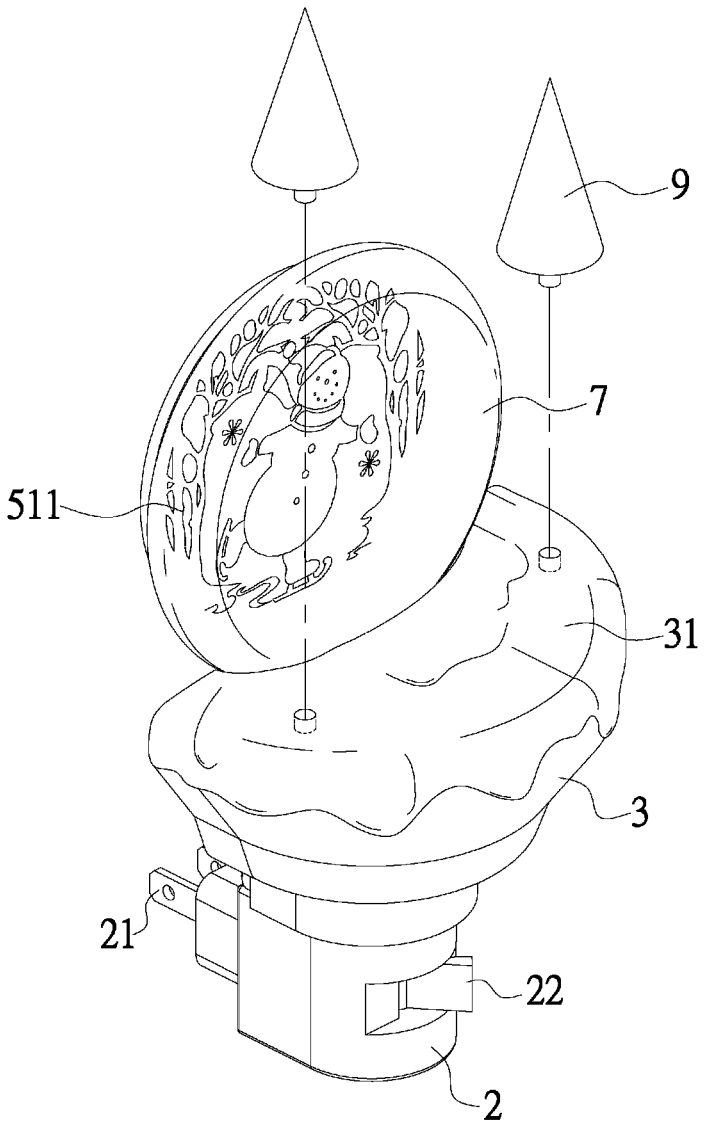
FIG. 8 is an exploded view showing another exemplary embodiment of the present invention.
Figure 9:
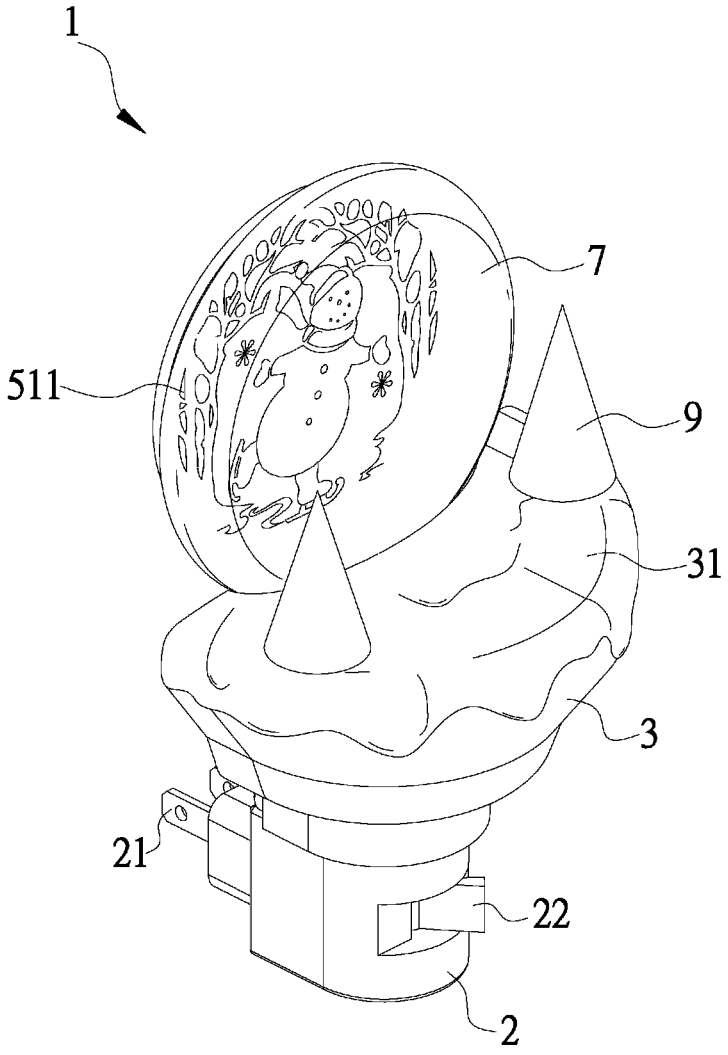
FIG. 9 is a perspective view showing the exemplary embodiment of FIG. 8 in an assembled form.

Further referring to FIGS. 8 and 9, the casing (3) has an upper end in which two recesses (38) are formed and spaced from each other. Each of the recesses (38) may receive a decoration (9) to insert therein. The decorations (9) may have outer configurations that match the patterns (511), (521) of the light-transmitting unit (5) to additional provide the present invention with a decorative effect. In the instant embodiment, the decorations (9) are shown to be trees that are taken as an example for illustration, but are not limited to such a configuration. In summary, the flashing night light (1) according to the present invention provides a function of lighting and also achieves a dynamic and gorgeous visual effect. When no electrical power is applied, the present invention can serve as a decoration. As such, multiplicity of function can be achieved to help improve market competition power of a product of the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A flashing night light, comprising:

a night light base, which has a side on which electric main connection terminals are mounted for connection with a power supply to receive electricity therefrom;

a casing, which is of a three-dimensional configuration and has one side fixed to the night light base;

a control circuit, which comprises a control substrate and a plurality of light-emitting elements, the control substrate being mounted to the casing, the light-emitting elements being mounted to the control substrate in an spaced and alternating manner and controlled by the control substrate to sequentially lighten; and a light-transmitting unit, which comprises a first light-transmitting plate and a second light-transmitting plate that are light transmittable and are arranged to overlap each other, the first light-transmitting plate and the second light-transmitting plate each having a surface on which a predetermined pattern is formed, the patterns being arranged according to a sequence for desired displaying, each of the first light-transmitting plate and the second light-transmitting plate comprising a light receiving section, the light receiving sections being arranged to alternate in position and respectively corresponding to the light-emitting elements and being fixed to the control substrate.

2. The flashing night light according to claim 1, wherein the casing has one side that is open to form an opening side, the casing being mounted to the night light base with the opening side and comprising a constraint plate positioned against the opening side.

3. The flashing night light according to claim 1 further comprising an aqua-sphere body, which is of a light-transmitting three-dimensional configuration and has one side forming a planar section and comprises a thick and flowable liquid and glitter hermetically enclosed therein, the aqua-sphere body being securely fixed to the casing the planar section facing a direction toward the connection terminals and bonded to a side of the light-transmitting unit.

4. The flashing night light according to claim 3 further comprising at least one fixing block, which is positioned against the aqua-sphere body and is secured by a threading fastener to the opening side of the night light base.

5. The flashing night light according to claim 1, wherein the casing comprises at least one decoration mounted to an end thereof and matching the patterns.

6. The flashing night light according to claim 1, wherein the night light base comprises a power switch for controlling conduction and cut-off of the power supply.

* * * * *